US007170485B2

(12) United States Patent
Huang

(10) Patent No.: US 7,170,485 B2
(45) Date of Patent: Jan. 30, 2007

(54) OPTICAL DISPLAY DEVICE HAVING A MEMORY TO ENHANCE REFRESH OPERATIONS

(75) Inventor: Samson Huang, Saratoga, CA (US)

(73) Assignee: Intel Corporation, Santa Clara, CA (US)

( * ) Notice: Subject to any disclaimer, the term of this patent is extended or adjusted under 35 U.S.C. 154(b) by 248 days.

(21) Appl. No.: 09/493,319

(22) Filed: Jan. 28, 2000

(65) Prior Publication Data

US 2003/0016213 A1 Jan. 23, 2003

(51) Int. Cl.
*G09G 3/36* (2006.01)

(52) U.S. Cl. ..... 345/98; 345/204

(58) Field of Classification Search ..... 345/92, 345/95, 100, 84, 90, 98, 204–206
See application file for complete search history.

(56) References Cited

U.S. PATENT DOCUMENTS 5,111,195 A * 5/1992 Fukuoka et al. ..... 345/204
5,170,155 A * 12/1992 Plus et al. ..... 345/100
5,332,997 A * 7/1994 Dingwall et al. ..... 341/150
5,339,090 A * 8/1994 Crossland et al. ..... 345/90
5,448,258 A * 9/1995 Edwards ..... 345/90
5,739,805 A * 4/1998 Dingwall ..... 345/100
5,771,031 A * 6/1998 Kinoshita et al. ..... 345/98
5,793,348 A * 8/1998 Lee et al. ..... 345/98
5,923,311 A * 7/1999 Edwards ..... 345/92
5,945,972 A * 8/1999 Okumura et al. ..... 345/98
5,977,940 A * 11/1999 Akiyama et al. ..... 345/94
6,005,558 A * 12/1999 Hudson et al. ..... 345/204
6,169,508 B1 * 1/2001 Edwards ..... 341/150
6,297,787 B1 * 10/2001 Nishida ..... 235/1.3
6,333,737 B1 * 12/2001 Nakajima ..... 345/205
6,339,417 B1 * 1/2002 Quanrud ..... 345/98
6,642,915 B1 * 11/2003 Booth et al. ..... 345/90

FOREIGN PATENT DOCUMENTS

JP 10-253941 A * 9/1998

OTHER PUBLICATIONS

The New IEEE Standard Dictionary of Electrical and Electronics Terms, 5th Ed., 1993, p. 1101.*
Merriam-Webster's Collegiate Dictionary, 10th ed., 1999, p. 1127.*

* cited by examiner

*Primary Examiner*—Ricardo Osorio
(74) *Attorney, Agent, or Firm*—Trop, Pruner & Hu, P.C.

(57) ABSTRACT

A method includes providing a capacitor to maintain a terminal voltage of a pixel cell near a predetermined voltage. A memory is provided to store a digital indication of the predetermined voltage, and during a refresh operation, the digital indication is converter into an analog voltage to update a charge on the capacitor. A light modulator cell includes a pixel cell, a capacitor, a memory and a digital-to-analog converter. The capacitor maintains a terminal voltage of the pixel cell near a predetermined voltage, and the memory stores a digital indication of the predetermined voltage. The digital-to-analog converter converts the digital indication into an analog voltage to update a charge on the capacitor during a refresh operation.

9 Claims, 4 Drawing Sheets

OPTICAL DISPLAY DEVICE HAVING A MEMORY TO ENHANCE REFRESH OPERATIONS

BACKGROUND

The invention generally relates to an optical display device, such as a silicon light modulator (SLM), for example.

Referring to FIG. 1, a silicon light modulator (SLM) 1 may include an array of LCD pixel cells 25 (arranged in rows and columns) that form corresponding pixels of an image. To accomplish this, each pixel cell 25 typically receives an analog voltage that controls the optical response of the pixel cell 25 and thus, controls the perceived intensity of the corresponding pixel. If the pixel cell 25 is a reflective pixel cell, the level of the voltage controls the amount of light that is reflected by the pixel cell 25, and if the pixel cell 25 is a transmissive pixel cell, the level of the voltage controls the amount of light that passes through the pixel cell 25.

There are many applications that may use the SLM 1. For example, a color projection display system may use three of the SLMs 1 to modulate red, green and blue light beams, respectively, to produce a projected multicolor composite image. As another example, a display screen for a laptop computer may include an SLM 1 along with red, green and blue color filters that are selectively mounted over the pixel cells to produce a multicolor composite image.

Regardless of the use of SLM 1, updates are continually made to the SLM cells 20 to refresh or update the displayed image. More particularly, each pixel cell 25 may be part of a different SLM cell 20 (an SLM cell 20*a*, for example), a circuit that includes the pixel cell 25 and typically includes a capacitor 24 that stores a charge to maintain the appropriate voltage on the pixel cell 25. The SLM cells 20 typically are arranged in a rectangular array 6 of rows and columns.

The charges that are stored by the SLM cells 20 typically are updated (via row 4 and column 3 decoders) in a procedure called a raster scan. The raster scan is sequential in nature, a designation that implies the SLM cells 20 of a row are updated in a particular order such as from left-to-right or from right-to-left.

As an example, a particular raster scan may include a left-to-right and top-to-bottom "zig-zag" scan of the array 6. More particularly, the SLM cells 20 may be updated one at a time, beginning with the SLM cell 20*a* that is located closest to the upper left corner of the array 6 (as shown in FIG. 1). During the raster scan, the SLM cells 20 are sequentially selected (for charge storage) in a left-to-right direction across each row, and the updated charge is stored in each SLM cell 20 when the SLM cell 20 is selected. After each row is scanned, the raster scan advances to the leftmost SLM cell 20 in the next row immediately below the previously scanned row.

During the raster scan, the selection of a particular SLM cell 20 may include activating a particular word, or row, line 14 and a particular bit, or column, line 16, as the rows of the SLM cells 20 are associated with row lines 14 (row line 14*a*, as an example), and the columns of the SLM cells 20 are associated with column lines 16 (column line 16*a*, as an example). Thus, each selected row line 14 and column line 16 pair uniquely addresses, or selects, a SLM cell 20 for purposes of transferring a charge (in the form of a voltage) from a signal input line 12 to the capacitor 24 of the selected SLM cell 20.

As an example, for the SLM cell 20*a* that is located at pixel position (0,0) (in cartesian coordinates), a voltage that indicates a new charge that is to be stored in the SLM cell 20*a* may be applied to one of the video signal input lines 12. To transfer this voltage to the SLM cell 20*a*, the row decoder 4 may assert (drive high, for example) a row select signal (called $ROW_0$) on a row line 14*a* that is associated with the SLM cell 20*a*, and the column decoder 3 may assert a column select signal (called $COL_0$) on column line 16*a* that is also associated with the SLM cell 20*a*. In this manner, the assertion of the $ROW_0$ signal may cause a transistor 22 (of the SLM cell 20*a*) to couple a capacitor 24 (of the SLM cell 20*a*) to the column line 16*a*, and the assertion of the $COL_0$ signal may cause a transistor 18 to couple the video signal input line 12 to the column line 16*a*. As a result of these connections, the voltage of the video signal input line 12 is transferred to the capacitor 24. The other SLM cells 20 may be selected for charge updates in a similar manner.

Typically, there are two types of charge updates: a frame update is used to update the intensities of the pixel cells 25 for a new frame of the displayed image and a refresh update is used to maintain the charge that is stored on the capacitor 24 between frame updates. Without the refresh updates, the pixels intensities may fade due to charge leakage and/or charge sharing.

Because the array 6 might be quite large, the number of signal lines 12 typically is considerably smaller than the number of column lines 16. Therefore, the signal lines 12 typically are used to sequentially access the SLM cells 20 K cells at a time (where "K" represents the number of signal lines and typically is less than the number (M) of columns) [at a time] by activating the appropriate transistors 18. Because only K bit lines 16 are driven with new values (and thus, only K transistors 18 are activated), the remaining column lines 16 are in a tri-state condition and are coupled to the nonselected capacitors 24 of the row. Therefore, charge sharing typically occurs between the capacitors 24 and the tri-stated column lines 16.

One way to minimize the effect of the charge sharing is through the refresh updates. Another way to minimize the effect of charge sharing is to ensure that each capacitor 24 has a large capacitance. However, large capacitances typically imply large capacitors that occupy a substantial amount of the silicon on which the SLM cell 20 is fabricated, leaving little space for other circuitry of the SLM cell 20.

Thus, there is a continuing need for an arrangement that addresses one or more of the problems that are stated above.

DETAILED DESCRIPTION

Figure 1:
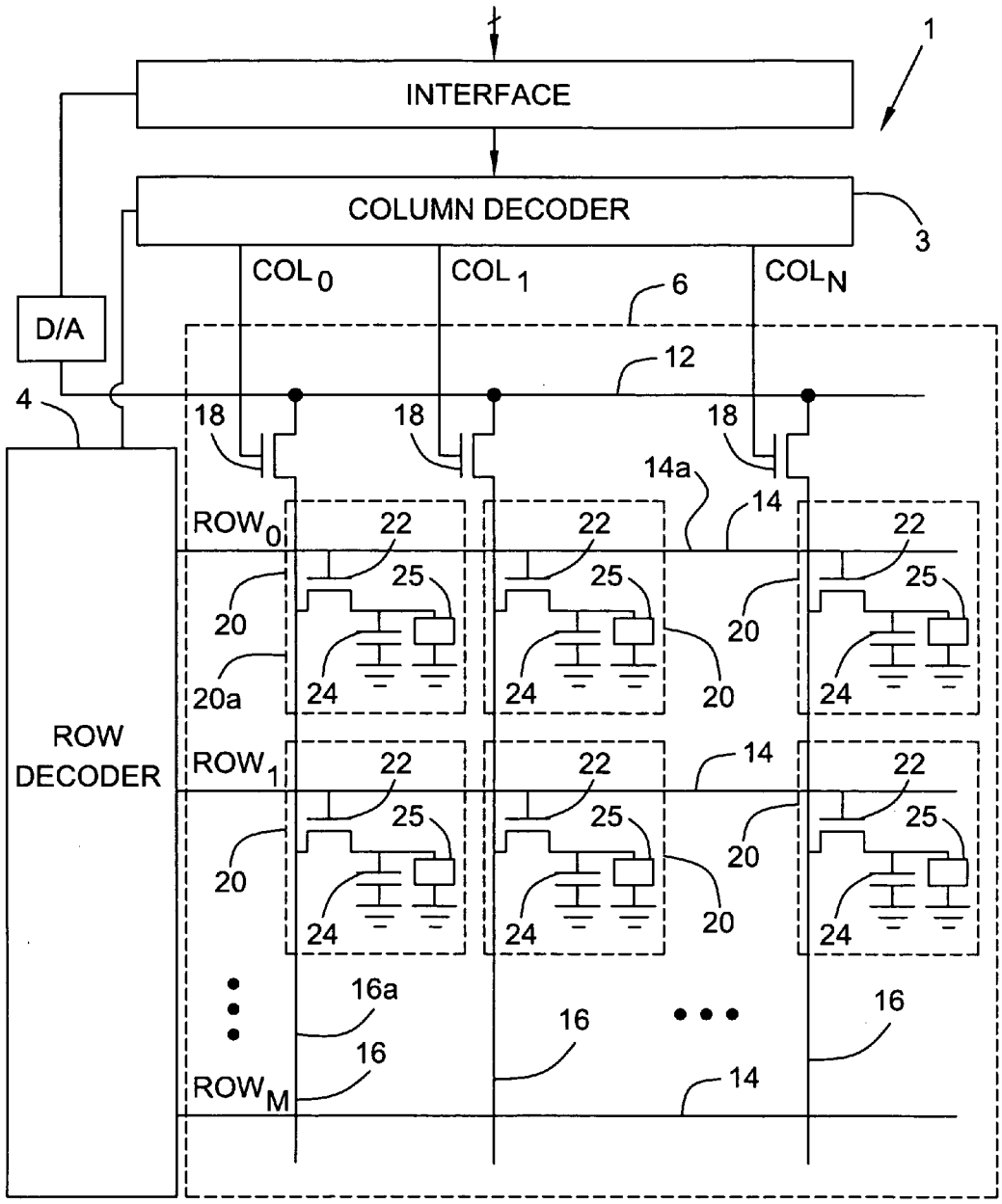
FIG. 1 (PRIOR ART)
FIG. 1 is a schematic diagram of a silicon light modulator (SLM) according to the prior art.
Figure 2:
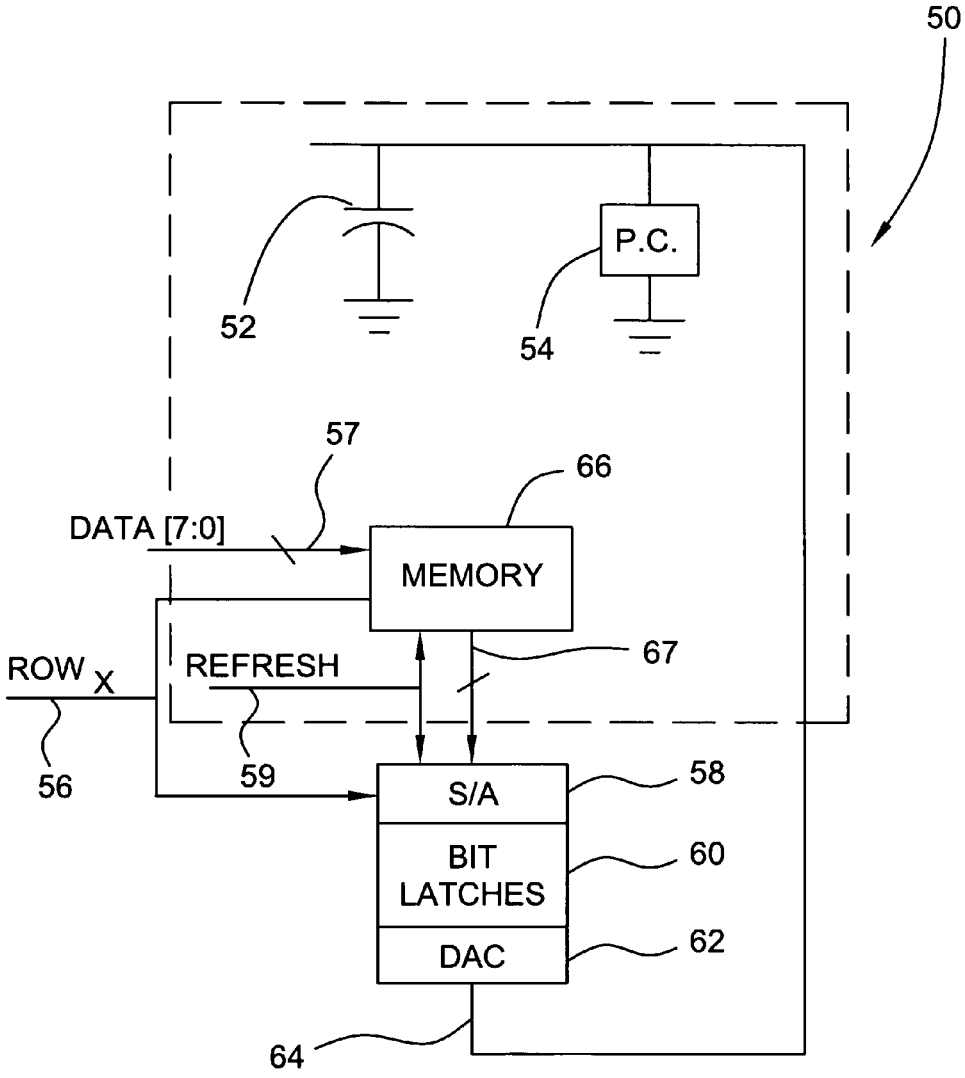
FIG. 2 is a schematic diagram of a silicon light modulator cell according to an embodiment of the invention.

Referring to FIG. 2, an embodiment 50 of an SLM cell in accordance with the invention includes a memory 66 (part of a larger static random access memory (SRAM), for example) that stores a digital indication of a pixel intensity for a pixel cell 54 (of the SLM cell 50). The SLM cell 50 may use a digital-to-analog converter (DAC) 62 to, during a refresh operation, convert the digital indication into an analog voltage to refresh the charge on a capacitor 52 (of the SLM cell 50) that furnishes the terminal voltage to a pixel cell 54 of the SLM cell 50. As an example, in some embodiments, the memory 66 may store eight bits that may indicate up to 256 different pixel intensity levels for the pixel cell 54.

The SLM cell 50 may be one of several SLM cells 50 of a row of an SLM. Due to the above described arrangement, all of the capacitors 52 in the SLM cells 50 of the row may be updated at the same time without coupling any of the capacitors 52 to a tristated bit, or column, line. Therefore, charge sharing between the capacitors 52 and the bit lines of the SLM does not occur, and thus, each capacitor 52 may be smaller than the traditional capacitor of the SLM cell. Furthermore, because the refresh operation is internal to each SLM cell 50, refresh operation may occur more often than conventional arrangements, an advantage that permits the size of each capacitor 52 to be even smaller.

For purposes of updating the memory 66 with a new value that indicates the pixel intensity of the next frame, a word, or row, line 56 that is associated with the row of the SLM cell 50 is asserted (driven high, for example) to cause the memory 66 to load the new data from the corresponding bit lines 57. At this time, sense amplifiers 58 respond to the new bit values to store the new values into bit latches 60 that store the bit values for conversion by the DAC 62. In this manner, the DAC 62 converts the digital value that is indicated by the bits into an analog voltage that appears on an analog line 64 that is coupled to a plate of the pixel cell 54. The other plate of the pixel cell 54 may be coupled to ground.

The refresh operation also uses the sense amplifiers 58, the bit latches 60 and the DAC 62. In this manner, a refresh signal line 59 may be asserted (driven high, for example) to indicate the refresh operation. When the word line 56 is also asserted, the sense amplifiers 58 generate signals to store bits (in the bit latches 60) that indicate the value that is stored in the memory 66. The DAC 62 then converts the digital value that is indicated by the bits into the analog voltage that appears on the line 64.

As an example, in some embodiments, the SLM cell 50 may be refreshed at a rate of approximately 1 KHz to minimize the appearance of an artifact, or error, when the SLM cell 50 is updated with the intensity value for the next frame. In some embodiments, the frame update occurs between the read cycle of the refresh operation. Therefore, for purposes of writing an indication of a new pixel intensity in the memory 66 for the next frame, the write operation may be synchronized with the refresh clock signal and then written into the memory 66 between two refresh cycles. Because the rate at which the memory 66 is updated is much lower than the refresh rate, there is always enough cycle to write new data into the memory 66.

Figure 3:
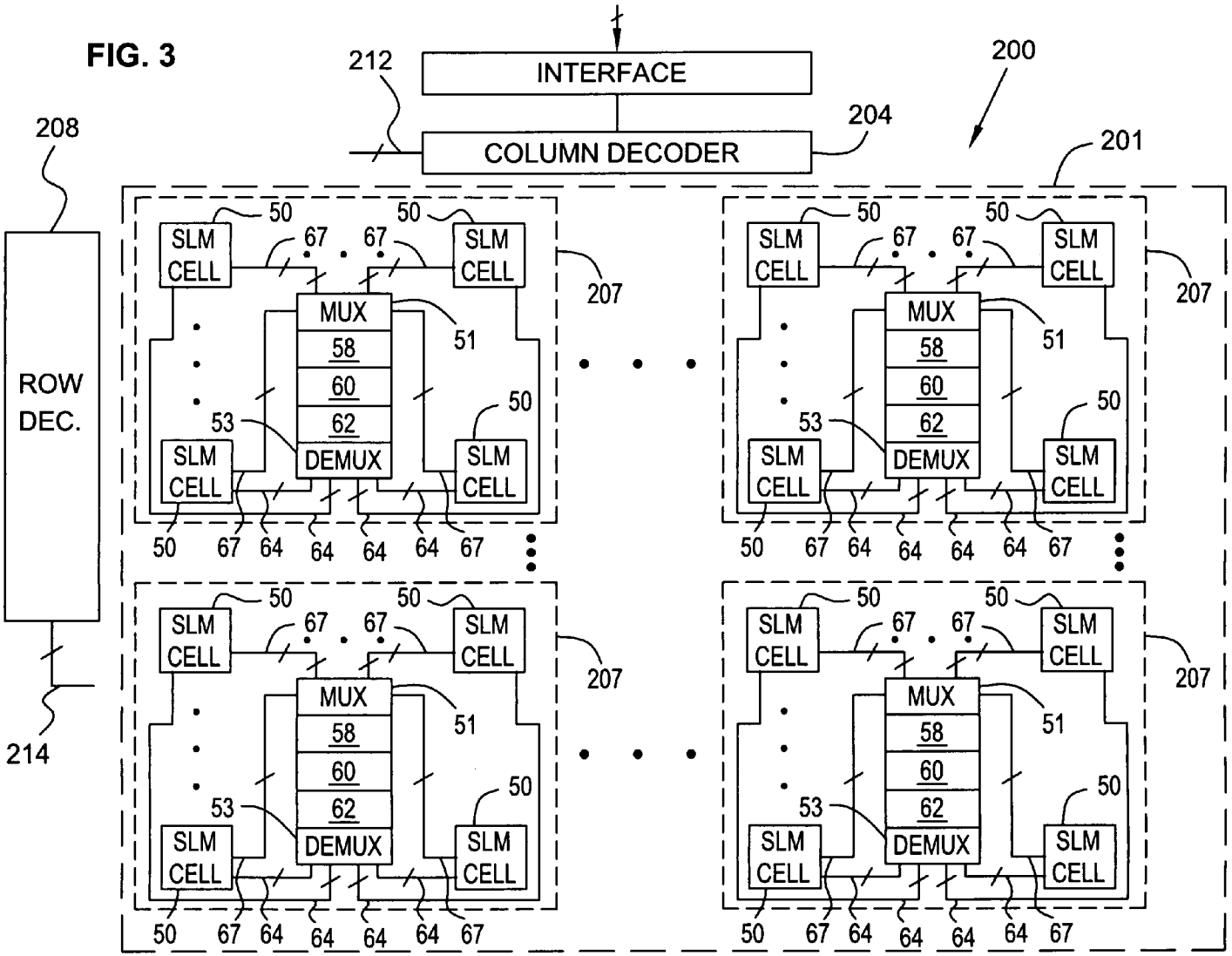
FIG. 3 is a schematic diagram of a silicon light modulator according to an embodiment of the invention.

Referring to FIG. 3, the SLM cell 50 may be used in an SLM 200 and may be one of several SLM cells 50 that are arranged in rows and columns. In some embodiments, the SLM 200 may include a row decoder 208 that includes control lines 214 to select a particular row of SLM cells 50 for raster scan updates or a refresh operation, and the SLM 200 may include a column decoder 204 that includes control and data lines 212 to update the memories 66 of a group of the SLM cells 50 of a particular row. In this manner, in some embodiments, to perform a raster scan, the row decoder 208 may select the SLM cells 50 one row at a time. For each selected row, the column decoder 204 selects a group of the SLM cells 50, updates the memories of the selected group of SLM cells 50 and continues this process until the memories of all of the SLM cells 50 of the selected row have been updated. Other arrangements are possible.

In some embodiments of the invention, the SLM cells 50 may be arranged in a rectangular array 201 of units 207. In this manner, each unit 207 may include a block of thirty-two columns by sixteen rows of SLM cells 50. The SLM cells 50 of a particular unit 207 share sense amplifiers 58, bit latches 60 and DACs 62 that function as described above. A multiplexer 51 (of each unit 207) selectively couples the SLM cells 50 of a particular row of the block to the sense amplifiers 58 to perform a particular refresh operation, for example. A demultiplexer 53 (of each unit 207) selectively couples the output terminals 64 to the selected row of SLM cells 50 to complete the particular refresh operation, for example. To accomplish these features, each SLM cell 50 is coupled to the multiplexer 51 of its unit 207 via conductive lines 67.

Figure 4:
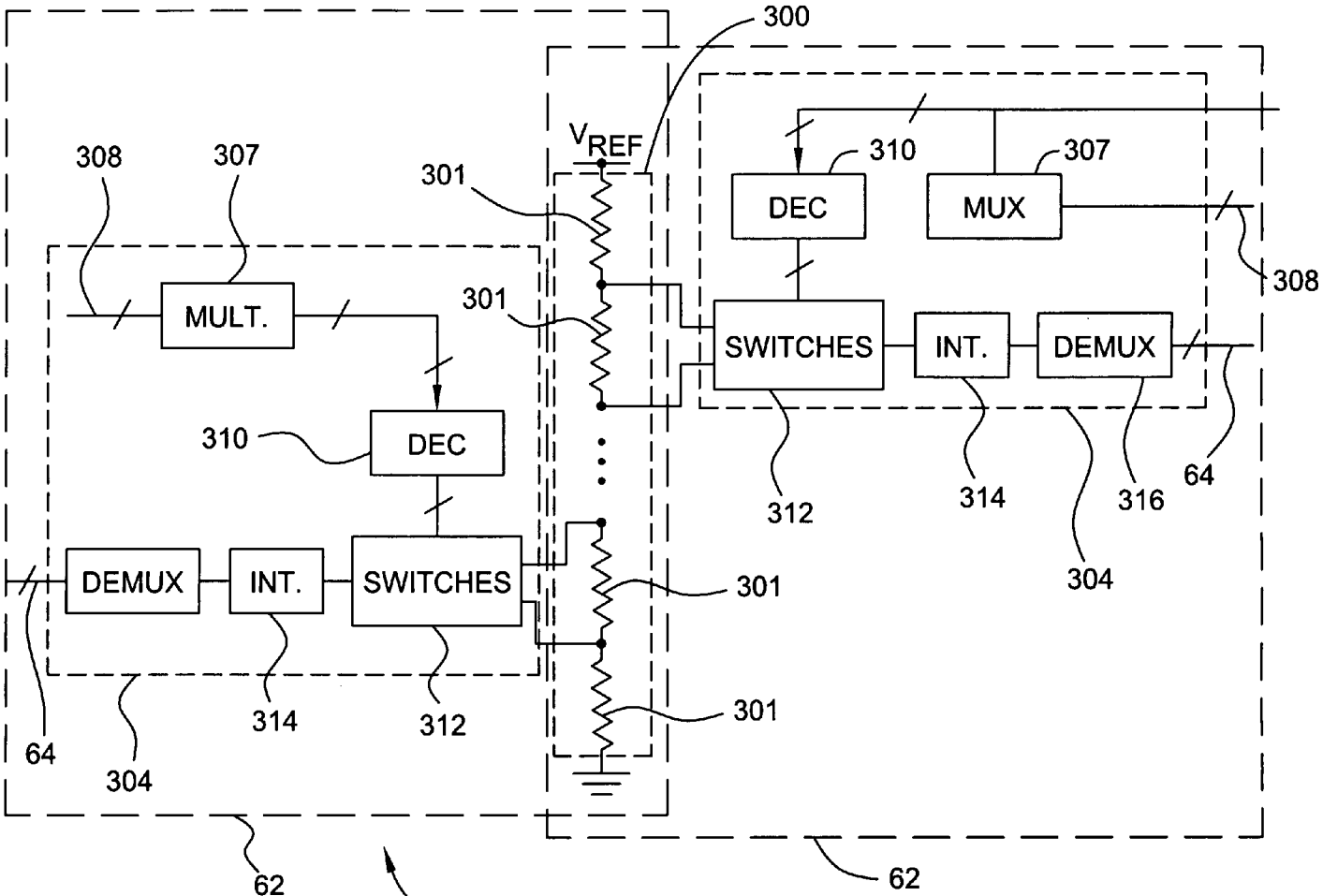
FIG. 4 is a schematic diagram of an arrangement to form multiple digital-to-analog converters of the SLM according to an embodiment of the invention.

Referring to FIG. 4, in some embodiments, the DACs 62 for a particular unit 207 may be part of a circuit 298. The circuit 298 may be associated with a block of thirty-two columns by sixteen rows of SLM cells 50. In this manner, in each refresh operation, the circuit 298 operates on the associated SLM cells 50 that are in a particular row. Thus, for the example above, in some embodiments of the invention, the circuit 298 performs the digital-to-analog conversions for thirty-two SLM cells 50 at time.

As an example, in some embodiments of the invention, the circuit 298 may include a resistor divider 300 that is formed from resistors 301 that are serially coupled between a reference voltage (called $V_{REF}$) and ground. The terminals of the resistors 301 provide reference voltages that the second stages 304 of the various DACs 62 use to furnish their analog signals based on the values that are stored in the respective memories 66. As an example, each second stage 304 may include a mulitplexer 307 that has input terminals 308 that are coupled to receive indications of the bits from the SLM cells 50 of the unit 207. In this manner, each multiplexer 307 is associated with a different column and selects the bits from the memory 66 of an SLM cell 50 of the selected row. The multiplexer 307 directs indications of these bits into a decoder 310. The decoder 310, in turn, operates switches 312 that receive the voltage across one of the resistors 301. The switches 312 furnish an analog voltage that is proportional to the value that is indicated by the bits, and an analog interface 314 scales this voltage before providing the voltage to a demultiplexer 316 that furnishes the scaled analog voltage to the appropriate capacitor 52. Thus, due to the above-described arrangement, each DAC 62 includes the resistor divider 300 (that forms the first stage) and the second stage 304.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A method comprising:

providing a light modulator comprising an array of pixel cells and memory buffers, each memory buffer being associated with a different group of two or more of the pixel cells and each memory buffer being located closer to the associated group of pixel cells than another one of the group of pixel cells; and providing a refresh signal;

in response to the refresh signal, reading digital indications stored in the memory buffers, converting the digital indications into analog voltages and updating charge intensities on the pixel cells using the analog voltages.

2. The method of claim 1, wherein the memory buffers are localized to the different groups.

3. The method of claim 1, wherein the memory buffers comprise a static random access memories.

4. The method of claim 1, further comprising: during the refresh operation, latching the digital indications.

5. The method of claim 1, further comprising:

in response to a change in a state of the refresh signal, reading the digital indications stored in the memory buffers, converting the digital indications into the analog voltages and updating the charge intensities.

6. The method of claim 1, further comprising:

responding with a sense amplifier to the refresh signal to read the digital indications stored in the memory buffers.

7. A light modulator comprising:

an array of pixel cells;

memory buffers being spatially distributed among the pixel cells, each memory buffer being associated with a different group of two or more of the pixel cells and storing a digital indications of associated predetermined voltages;

digital-to-analog converters to convert the digital indications into analog voltages to update charges on the pixel cells; and sense amplifiers to respond to a refresh signal, to read the digital indications from the memory and provide the digital indications to the digital-to-analog converters.

8. The light modulator of claim 7, wherein the refresh operation occurs at a different rate than a frame update operation to the pixel cells.

9. The light modulator of claim 7, wherein at least one of the memory buffers comprise static random access memory.

* * * * *